United States Patent [19]

Ogle

[11] 3,941,171

[45] Mar. 2, 1976

[54] FLUID TRANSFER DEVICE

[75] Inventor: Robert W. Ogle, Newport Beach, Calif.

[73] Assignee: IMS Limited, S. El Monte, Calif.

[22] Filed: July 5, 1973

[21] Appl. No.: 376,588

[52] U.S. Cl. ..... 141/309; 141/329; 128/272

[51] Int. Cl.[2] ..... B67C 3/02

[58] Field of Search..... 128/272, DIG. 4, DIG. 5, 128/221, 276; 137/575; 141/285, 309, 329, 330, 19, 319; 23/253, 259; 206/47 A, 63.2 R, 63.4; 222/80, 189, 85, 478; 285/3, 4; 150/52 R

[56] References Cited

UNITED STATES PATENTS

| | | | |
|---|---|---|---|
| 1,526,595 | 2/1925 | Gillman | 128/276 |
| 2,284,166 | 5/1942 | Pye | 141/59 |
| 2,435,033 | 1/1948 | Campbell | 141/319 |
| 2,584,397 | 2/1952 | Pitman | 141/375 |
| 2,737,948 | 3/1956 | Brown | 128/221 |
| 2,941,531 | 6/1960 | Stevens | 128/221 |
| 3,089,491 | 5/1963 | Mirow | 128/221 |
| 3,156,272 | 11/1964 | Indrunas | 141/309 |

FOREIGN PATENTS OR APPLICATIONS

| | | | |
|---|---|---|---|
| 1,122,616 | 5/1956 | France | 128/272 |

*Primary Examiner*—Houston S. Bell, Jr.
*Attorney, Agent, or Firm*—Wills, Green & Mueth

[57] ABSTRACT

A fluid transfer device comprising two parallel fluid passages, both carried by a flange which is generally perpendicular to said passages, the improvement wherein the two ends of said passages on each of said flanges are longitudinally displaced from one another. The combination of a fluid transfer device comprising two parallel fluid passages, both carried by a flange which is generally perpendicular to said passages, the improvement wherein the two ends of said passages on each side of said flange are longitudinally displaced from one another; and a medicament container having an open end, an imperforate rubber stopper in said open end which seals said container, the one end of each of said fluid passages being adapted to pierce said stopper with said flange abutting the exterior of said stopper.

3 Claims, 12 Drawing Figures

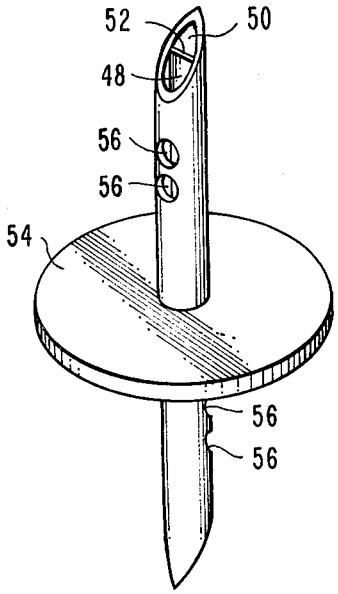
FIG.—4
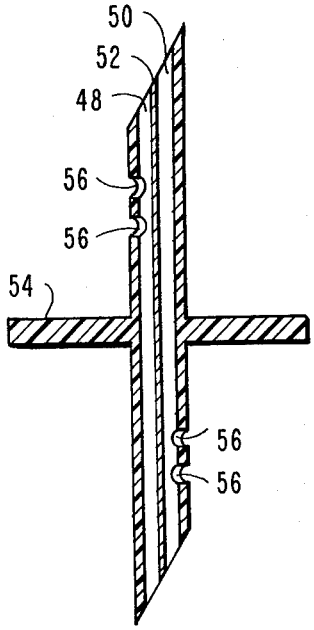
FIG.—6
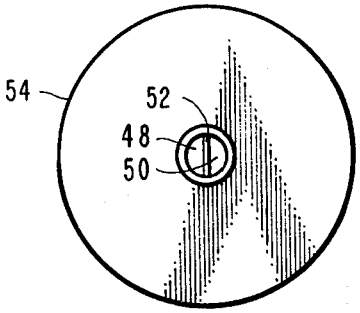
FIG.—5
FIG.—8
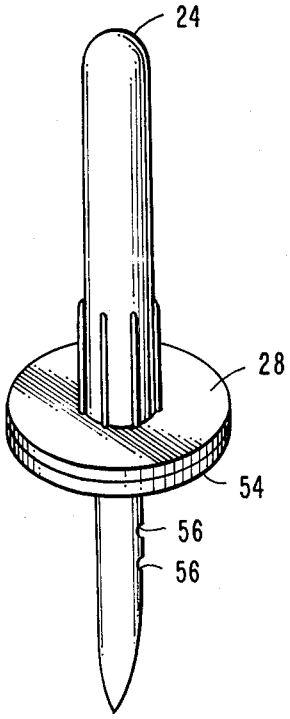

FLUID TRANSFER DEVICE

BACKGROUND OF THE INVENTION

In my copending application, I have pointed out that many medicaments are prepared, stored and supplied in dry or lyophilized form. Such medicaments must be reconstituted at the time of use by the addition of a diluent thereto. Various methods of adding the diluent to the dry or lyophilized medicament have been used. One method in common use is the "open-pour" technique in which the diluent, such as a bottle of intravenous solution, or other source of diluent, is opened and some of the contents poured into the vial or bottle containing the dry or lyophilized material. After reconstitution, the liquid is usually returned to the diluent bottle or vial. This technique is unsatisfactory because both the dry or lyophilized material and the diluent are exposed to ambient airborne bacterial contamination. The "intravenous set transfer" technique requires not only an intravenous solution set and stand, but also a needle for venting or a special dispensing cap. When reconstitution is accomplished using an ordinary syringe to transfer diluent into the container for the dry or lyophilized material, the needle is exposed to constant airborne contamination.

The invention of my copending application is concerned with solving and avoiding the problems associated with the prior art. The present invention is an improvement in and on said invention whereby the transfer is easy and generally can be made to occur in less time, thereby making the device more acceptable to nurses and other users of reconstitutable medication.

SUMMARY OF THE INVENTION

It is an object of this invention to provide an improved means for the reconstitution of dry or lyophilized medication.

More particularly, it is an object of my invention to provide a fluid transfer device which more readily and speedily permits such reconstitution in an essentially closed system.

These and other objects and advantages of this invention will be apparent from the detailed description which follows, taken in conjunction with the accompanying drawings.

DESCRIPTION OF PREFERRED EMBODIMENTS

In the drawings:

FIG. 4 is a perspective view of another embodiment of the transfer device of this invention;

FIG. 5 is an end view of the device of FIG. 4;

FIG. 6 is a sectional view taken along the line 5—5 of FIG. 5;

FIG. 8 is a perspective view of the device of FIG. 4 with the protective cover shown in FIG. 7;

Figure 1:
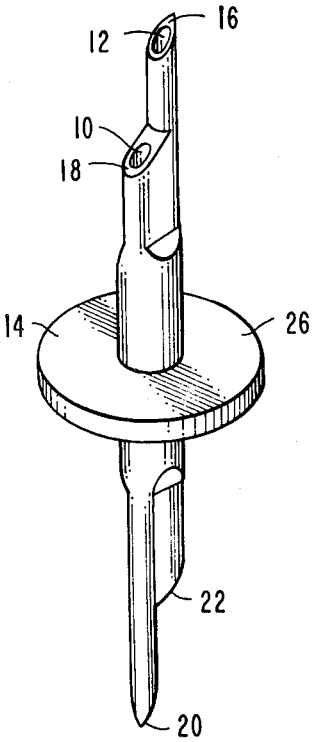
FIG. 1 is a perspective view of one embodiment of the transfer device of my invention.

Turning to the drawings in greater detail, the embodiment of FIGS. 1 – 3, 7 and 9 – 12 comprises parallel fluid passages 10 and 12 and flange 14. The fluid passages are approximately equal in length but staggered so that the bias-cut ends or openings 16 and 18, and 20 and 22, are not immediately adjacent each other. Preferably, the one end of the device is covered with a protective cap. Cap 24 shown in FIG. 7 inside forms an interference or press fit with the enlarged circular base portion 26 of the transfer device to form a fluid-tight seal. The cap 24 has a flange portion 28 which abuts flange 14 when the cap is fully advanced over the fluid transfer device.

Figure 9:
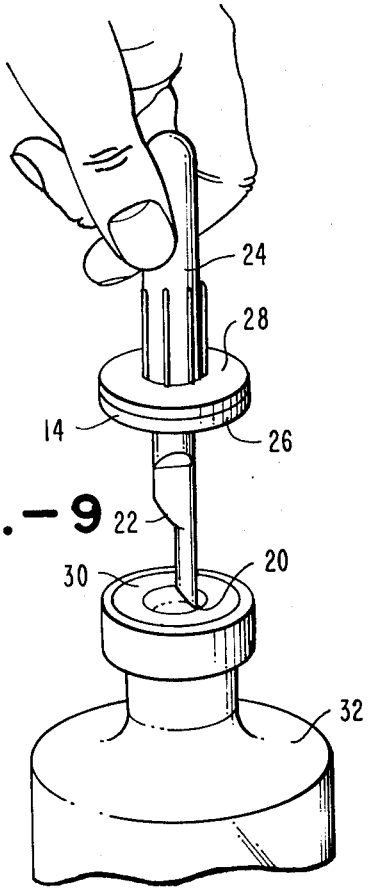
FIG. 9 shows the initial step on the use of the transfer device of FIGS. 1–3 and 7.
Figure 11:
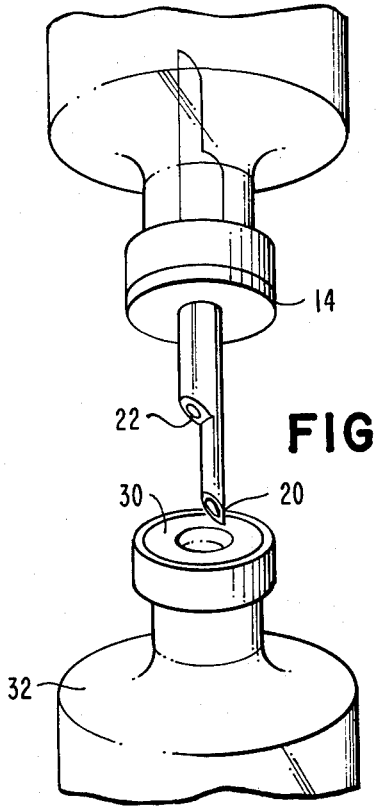
FIG. 11 shows the next step in sequence with the transfer device being inserted into the stoppered opening of a diluent bottle or vial.
Figure 10:
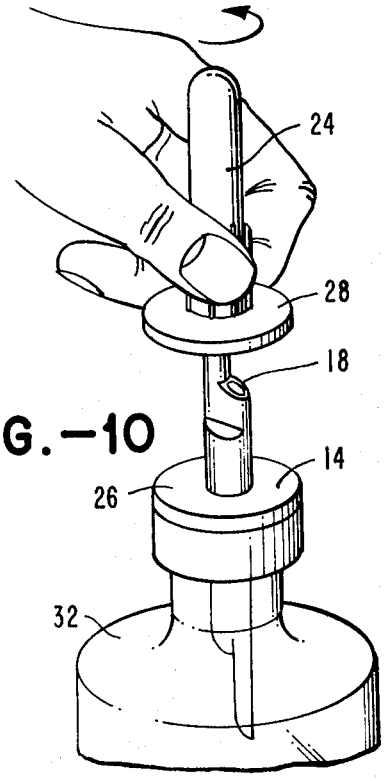
FIG. 10 shows the next step.
Figure 12:
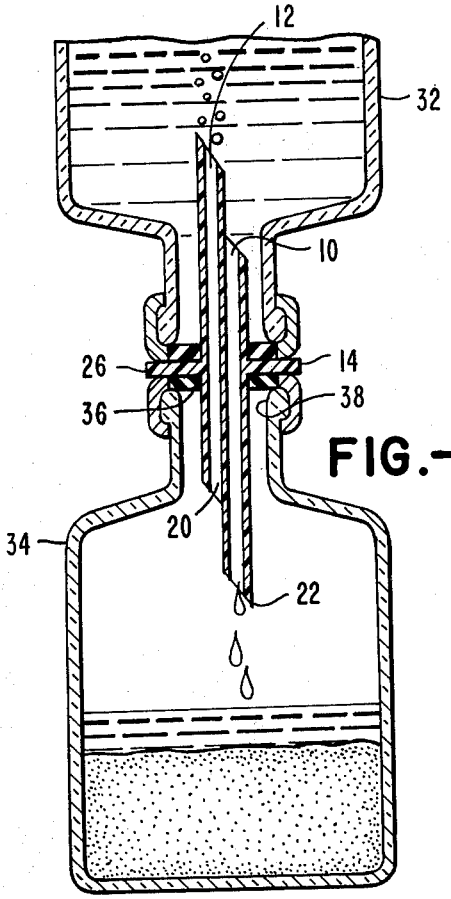
FIG. 12 is a side sectional view showing the operation of the device of FIGS. 1 – 3 in the transfer of fluid between medicament containers.

In use, the device as shown in FIG. 9, normally shipped in an imperforate tear-away, thin plastic bag, is forced downwardly through the stopper (usually rubber) 30 on the container 32 for the dry or lyophilized material until flange 14 abuts stopper 30. Then, as shown in FIG. 10, the cap 24 is removed with a twisting motion. The combination container 32 and fluid transfer device is then inverted as shown in FIG. 11 over the diluent container 34, which is also usually provided with a rubber stopper 36 in the neck 38 thereof. The points 20 and 22 are forced through stopper 36 until the containers are disposed as shown in FIG. 12. Fluid transfer then occurs automatically, with passage 10 acting as a diluent or liquid downcomer and passage 12 acting as a path for the displacement of air from container 32 upwardly into container 34. After transfer is complete, the empty diluent container 34 and the fluid transfer device are removed. The container 32 then contains the reconstituted medicament in sterile form. The container 32 can be used in a variety of ways. Typically, its contents are administered using a conventional intravenous solution set. However, this invention is not so limited and is applicable to the transfer of liquids between any stoppered containers.

Alternatively, the fluid transfer device may have the configuration shown in FIGS. 4 – 6 and 8. In said Figures, the passages 48 and 50 are formed by center divider 52. The flange is identified as 54. In large devices, the divider 52 is adequate to prevent the formation of a diluent or liquid slug in the air viser passage. In smaller size transfer devices, this is not true, in which case it is necessary to provide pressure relieving openings 56. The openings 56 prevent a fluid slug from forming and shutting off the transfer of liquid and air. The transfer device of FIGS. 4 – 6 and 8 are used with diluent container and dry or lyophilized material container in the manner previously described.

Figure 3:
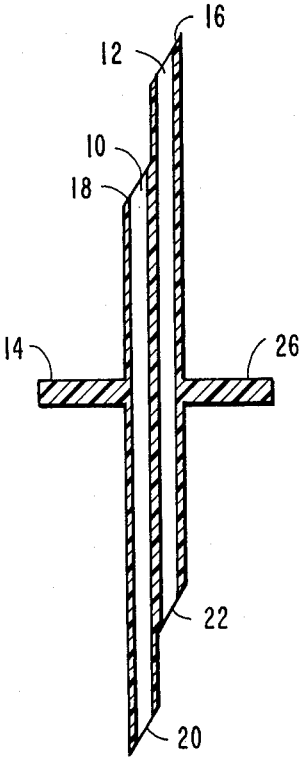
FIG. 3 is a side sectional view along the line 3—3 of FIG. 2.
Figure 2:
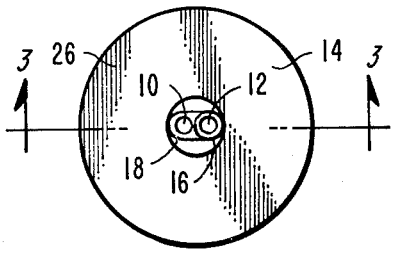
FIG. 2 is an end view of the device of FIG. 1.
Figure 7:
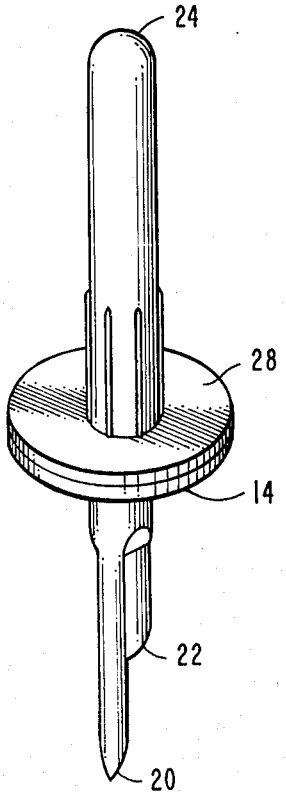
FIG. 7 is a perspective view showing the device of FIG. 1 with a protective cover thereover.

The fluid transfer device of FIGS. 4 – 6 is generally smaller in diameter than the device of FIGS. 1 – 3, and hence is adapted to be used with small-necked bottles and vials.

Having fully described the invention, it is intended that it be limited only by the lawful scope of the appended claims.

I claim:

1. A fluid transfer device comprising two parallel fluid passages within a single elongated rigid member having open cutting ends, said rigid member being carried by a generally disk-like flange disposed midway between the ends of said rigid member which is generally perpendicular to said passages, the improvement wherein said passages are of equal length and the two open ends of said passages on each side of said flanges are longitudinally displaced from one another, and further wherein said rigid member is provided with at least one lateral air hole in one of said passages and, on the opposite of said flange, the other of said passages is provided with at least one lateral hole to prevent the formation of fluid slug.

2. The device of claim 1 wherein said rigid member is provided with at least one lateral hole in one of said passages and, on the opposite of said flange, the other of said passages is also provided with at least one lateral hole, the lateral holes on opposite sides of said flange being equidistant from said flange.

3. The device of claim 1 wherein said rigid member is provided with two lateral holes in one of said passages and on the opposite of said flange the other of said passages is also provided with two lateral holes, the lateral holes on opposite sides of said flange being equidistant from said flange.

* * * * *